United States Patent [19]

Engelmohr et al.

[11] Patent Number: 4,813,620

[45] Date of Patent: Mar. 21, 1989

[54] SORTING APPARATUS FOR THE MATERIAL OUTLET OF A MACHINE FOR BREAKING-UP SCRAP

[75] Inventors: Franz Engelmohr, Hess.-Lichtenau; Josef Weber, Melsungen, both of Fed. Rep. of Germany

[73] Assignee: Thyssen Industrie AG, Essen, Fed. Rep. of Germany

[21] Appl. No.: 134,936

[22] Filed: Dec. 18, 1987

[30] Foreign Application Priority Data

Dec. 19, 1986 [DE] Fed. Rep. of Germany ..... 3643529

[51] Int. Cl.[4] ..... B02C 13/286

[52] U.S. Cl. ..... 241/82; 241/186.2; 241/189 R; 241/285 B

[58] Field of Search ..... 241/73, 186 R, 189 R, 241/82, 285 B, 285 A, 186.2

[56] References Cited

U.S. PATENT DOCUMENTS

| | | | |
|---|---|---|---|
| 3,455,517 | 7/1969 | Gilbert | 241/189 R |
| 4,000,860 | 1/1977 | Gotham | 241/285 B X |
| 4,146,184 | 3/1979 | Whitney | 241/285 A X |
| 4,544,105 | 10/1985 | Carlsson | 241/285 A X |

*Primary Examiner*—Mark Rosenbaum

*Attorney, Agent, or Firm*—Becker & Becker, Inc.

[57] ABSTRACT

A sorting apparatus for the material outlet of a machine for breaking-up scrap. The machine has a horizontally disposed hammer breaker rotor that is disposed in a housing, the bottom of which is trough-shaped. A material inlet that extends to the rotor and includes an anvil is produced at the downwardly rotating side of the rotor. An impact or deflection chamber having an outlet opening is disposed above the rotor. The housing has a curved inner surface portion in the bottom trough, and a further inner surface that adjoins the curved inner surface portion and is on the upwardly rotating side of the rotor. The further inner surface is provided with ribs that are disposed parallel to the direction of movement of broken-up scrap. The open distance between adjacent ribs is approximately equal to the greatest desired diameter of broken-up and compressed scrap pieces. Channels are formed between adjacent ribs for respective streams of broken-up scrap. A deflector rim is disposed above the ribs and extends parallel to the axis of rotation of the rotor. The deflector rim, in conjunction with the further inner surface of the housing, defines unobstructed openings for the upper ends of the channels, with these unobstructed openings being adjustable during operation of the machine.

7 Claims, 2 Drawing Sheets

FIG-1
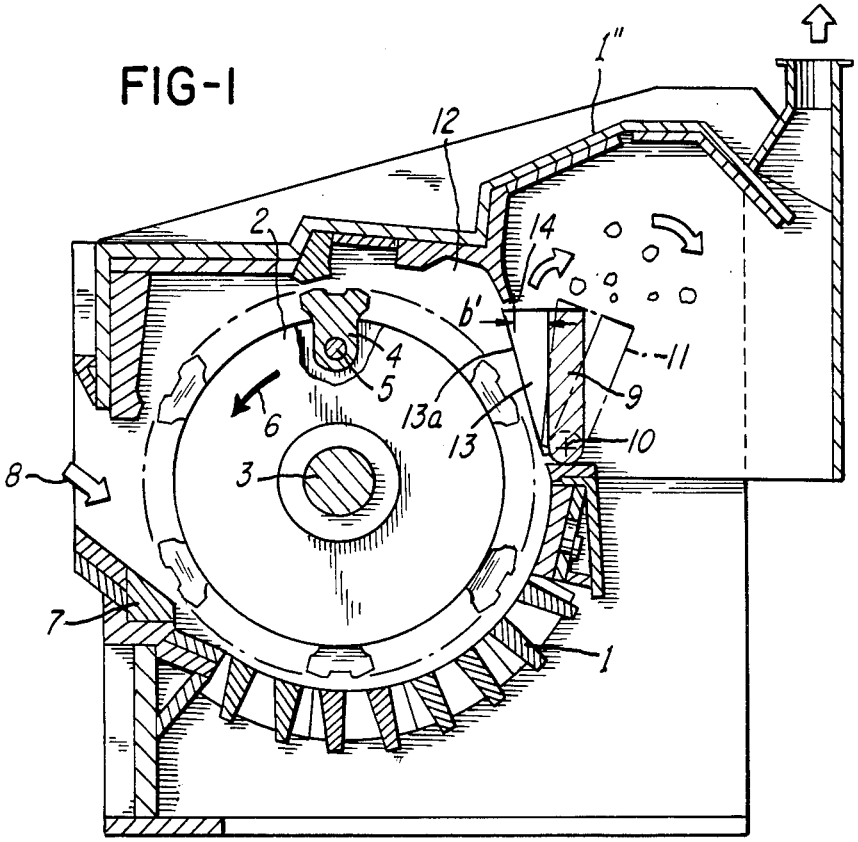
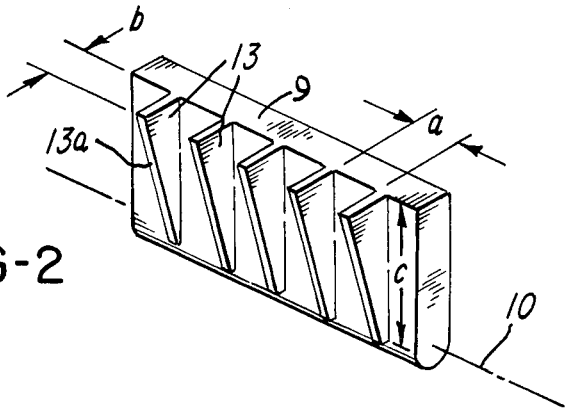
FIG-2

FIG-3
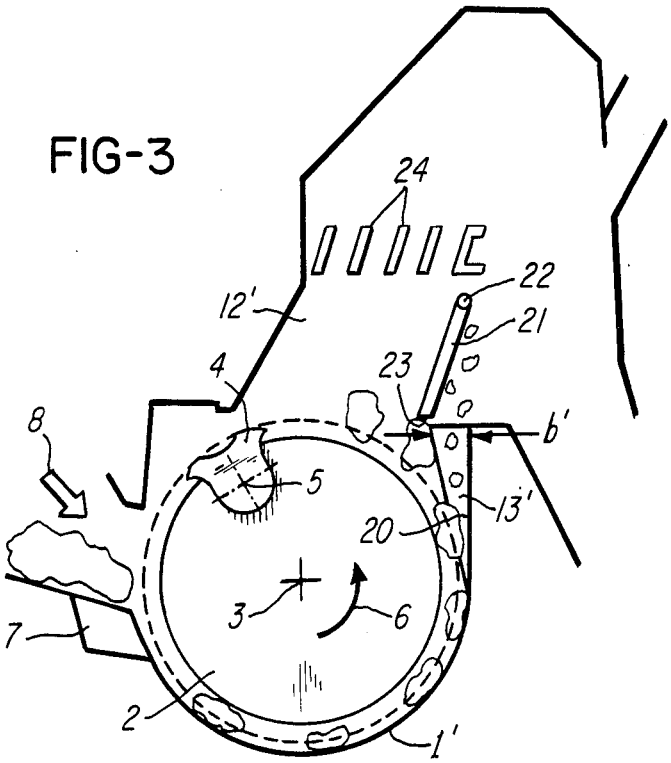
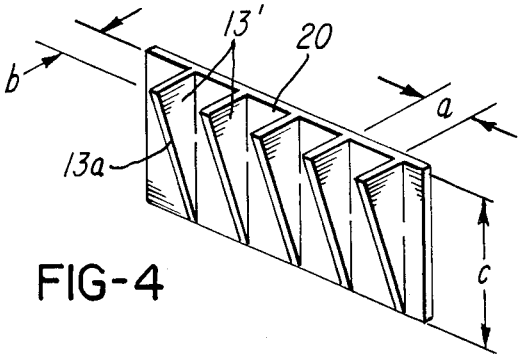
FIG-4

SORTING APPARATUS FOR THE MATERIAL OUTLET OF A MACHINE FOR BREAKING-UP SCRAP

BACKGROUND OF THE INVENTION

The present invention relates to a sorting apparatus for the material outlet of a machine for crushing or breaking-up scrap. The machine has a horizontally disposed hammer crusher or breaker rotor that is disposed in a housing, the bottom of which is trough-shaped. A material inlet that extends to the rotor and includes an anvil is provided at the downwardly rotating side of the rotor, and an impact or deflection chamber that has outlet opening means is disposed above the rotor.

Scrap pieces of various shapes and sizes are produced when scrap, such as automobile bodies or waste scrap, is crushed or broken-up in machines that have a horizontally disposed hammer crusher or breaker rotor. To further process the broken-up scrap, it is necessary that the individual pieces of scrap not exceed a desired size. In order to maintain as great a throughput of scrap as possible with such breaking-up machines, scrap pieces having no more than the desired maximum dimensions should leave the working area of the hammers as quickly as possible.

To accomplish this requirement, it is known to dispose gratings in the wall of the impact or deflection chamber that is disposed above the hammer breaker rotor, with this grating making it possible for pieces of scrap up t o the desired maximum size to be withdrawn outwardly (see U.S. patent application Ser. No. 791,220 Häusler et al., filed Oct. 25, 1985, now U.S. Pat. No. 4,730,791 Häusler et al. which issued Mar. 15, 1988 and belongs to the assignee of the present application). Unfortunately, such gratings in the form of material outlets have the drawback that when dirty scrap, such as waste scrap or scrap from automobile bodies, is broken up, the gratings become clogged, even though a number of broken-up and compressed pieces of scrap have already obtained the desired dimensions. Balls of scrap then build up ahead of the grating; these balls either drop off suddenly by themselves, hence leading to blockage of the hammer breaker rotor, or the rotor must be stopped, a flap in the wall of the housing must be opened and the balls must be removed from the outside by actually reaching into the apparatus.

Another drawback of having such gratings in the material outlet is that during operation of the crushing or breaking-up machine, there is no possibility of altering the presettings for the desired maximum dimensions of the broken-up and compressed pieces of scrap. This can be accomplished only when the apparatus is shut down and the grating is replaced with a grating that has a different gap width or mesh size.

It is an object of the present invention to provide a sorting apparatus of the aforementioned general size where scrap pieces of up to the desired maximum dimensions can leave the apparatus as quickly as possible, with the presettings for the desired maximum dimensions of the scrap pieces being capable of being altered during operation of the breaking-up machine and the sorting apparatus.

BRIEF DESCRIPTION OF THE DRAWINGS

This object, and other objects and advantages of the present invention, will appear more clearly from the following specification in conjunction with the accompanying schematic drawings, in which:

FIG. 1 is a vertical cross-sectional and partially broken-away view of one exemplary embodiment of the inventive sorting apparatus for a breaking-up machine that has a horizontally disposed hammer breaker rotor;

FIG. 2 is a detailed perspective view of the flap and rib portion of the machine of FIG. 1;

FIG. 3 is a simplified vertical cross-sectional view through another exemplary embodiment of the inventive sorting apparatus for a breaking-up machine that has a horizontally disposed breaker rotor; and FIG. 4 is a detailed perspective view of the housing wall and ribs of the machine of FIG. 3.

SUMMARY OF THE INVENTION

The sorting apparatus of the present invention is characterized primarily in that: the housing has a curved inner surface portion in the bottom trough, and a further inner surface that adjoins the curved inner surface portion and is on the upwardly rotating side of the rotor. The further inner surface is provided with ribs that are disposed parallel to the direction of movement of broken-up scrap, with the open distance between adjacent ones of the ribs being approximately equal to the greatest desired diameter of broken-up and compressed pieces of scrap, and with respective channels being formed between adjacent ones of the ribs for respective streams of broken-up scrap; and deflector rim means is disposed above the ribs and extends parallel to the axis of rotation of the rotor, with the deflector rim means, in conjunction with the further inner surface of the housing, defining respective unobstructed heights or openings for the upper ends of the channels between the ribs, with these unobstructed openings being adjustable during operation of the machine, and leading out of the impact or deflection chamber.

Pursuant to one specific embodiment of the present invention, the further inner surface that is provided with the ribs is formed by that surface of a flap that faces the interior of the housing, with this flap also being adjustable during operation of the machine and having at the bottom a pivot shaft that is disposed approximately at the level of, and parallel to, the axis of rotation of the rotor; the deflector rim means for delimiting the unobstructed openings of the channels that are formed between the ribs is part of the housing.

Pursuant to a different specific embodiment of the present invention, the further inner surface that is provided with the rims is formed by that surface of the wall of the housing that faces the interior of the housing, with the deflector rim means that delimits the unobstructed openings of the channels that are formed between the rims being the bottom edge of a flap that is also adjustable during operation of the machine, and that is disposed above the wall that is provided with the ribs; the flap has a horizontal pivot shaft disposed at the top.

With both embodiments, the height of the ribs, i.e. the distance from the flap or from the wall of the housing, increases from the bottom toward the top, with the greatest height being equal to or greater than the greatest desired diameter of the broken-up and compressed pieces of scrap, and with the length of the ribs being greater than the greatest desired diameter of the broken-up and compressed pieces of scrap.

The advantages achieved with the configuration of the present invention are that the stream of broken-up scrap is divided into sufficiently broken-up scrap and scrap that must be further broken-up, with the sufficiently broken-up scrap leaving the interior of the housing without being unnecessarily retained therein. This results in an increase of the throughput of the breaking-up machine.

Further specific features of the present invention will be described in detail subsequently.

DESCRIPTION OF PREFERRED EMBODIMENTS

Referring now to the drawings in detail, FIG. 1 shows a hammer crusher or breaker rotor 2 mounted in the housing 1. The shaft or axis of rotation of the rotor 2 is designated by the reference numeral 3. Disposed on the periphery of the rotor 2 are hammers 4 that are secured to shafts 5, which are disposed parallel to the axis of rotation 3 of the rotor 2, in such a way as to be pivotable all the way around. During operation, the hammer breaker rotor 2 moves in the direction of the arrow 6, whereby the hammers 4, in cooperation with the anvil 7, crush or break up the material, such as automobile bodies or waste scrap, that is introduced in the direction of the arrow 8.

Disposed on the upwardly rotating side of the housing 1, the bottom of which is trough-shaped, and which in the illustrated embodiment is designed as a grating, is a gate or flap 9, t he nonillustrated length of which extends over the entire length of the housing 1. Via non-illustrated means, such as a hydraulic cylinder, the flap 9 is pivotable about the pivot shaft 10, even during operation, with the extreme position 11, which is indicated by dot-dash lines, showing the position that the flap 9 can assume in order to be able to remove or eject from the impact or deflection chamber 12 which is disposed above the rotor 2 scrap that has not or cannot be reduced to the desired size.

Plural ribs 13 are disposed on that surface of the flap 9 which faces the interior of the housing 1. These ribs 13 divide the stream of broken-up scrap that, tangential to the circumferential direction of the hammer breaker rotor 2, leaves the gap between the housing 1 and the rotor 2 into a plurality of parallel, narrow streams. As illustrated in FIG. 2, the distance "a" between the parallel ribs 3 is approximately equal to the greatest desired diameter of the broken-up and compressed scrap pieces. The height of the ribs 13, i.e. the distance thereof from the flap 9, increases from the bottom toward the top, with the greatest height "b" being equal to or greater than the greatest desired diameter of the broken-up and compressed scrap pieces.

Scrap pieces that have dimensions greater than that which are desired ar deflected toward the hammer breaker rotor 2 by the faces or ridges 13*a* of the ribs 13, or these oversized scrap pieces strike the deflector rim 14 that is disposed above the ribs 13 in the upper part 1" of the housing. The deflector rim 14 delimits the unobstructed height b' (see FIG. 1) of the channels between the ribs 13. By pivoting the flap 9 about the pivot shaft 10, this unobstructed height b' can be altered during operation. As a normal adjustment, the size of the unobstructed height b' is the same as the distance "a". However, as needed, the unobstructed height b' could also be greater or less than the distance "a" in order to also be able to convey larger or smaller scrap pieces out of the impact or deflection chamber 12 and out of the upper openings of the parallel channels between the ribs 13.

The length "c" of the ribs 13 is greater than the greatest desired diameter of the broken-up and compressed scrap pieces in order to be able to effectively convey the stream of material.

In the crushing or breaking-up machine illustrated in FIG. 3, the rotor arrangement essentially corresponds to that of the machine of FIG. 1. However, in this embodiment the ribs 13' that divide the stream of broken-up scrap into a plurality of parallel, narrow streams are disposed on that surface of the wall 20 of the housing 1' that faces the interior of the housing. The same particulars recited in conjunction with the ribs 13 of the embodiment of FIGS. 1 and 2 apply for the dimensions of the sizes and distances of the ribs 13'. Disposed above the ribs 13 is a gate or flap 21, at the top of which is provided a pivot shaft. Non-illustrated means, such as a hydraulic cylinder, serve for actuation of the flap 21. In the position illustrated in the drawing, the channels that pass between the ribs 13' are delimited with regard to their unobstructed height (similar to b' in FIG. 1) by the bottom edge 23 of the flap 21, which acts as a deflector rim. With this rib and flap arrangement also, as with the previously described arrangement, the sufficiently broken-up and compressed scrap can leave the interior of the housing without being unnecessarily retained therein. The grating 24 illustrated in the embodiment of FIG. 3 serves for the removal of dust that results during the breaking-up of waste scrap.

The present invention is, of course, in no way restricted to the specific disclosure of the specification and drawings, but also encompasses any modifications within the scope of the appended claims.

What we claim is:

1. In a sorting apparatus for the material outlet of a machine for crushing or breaking-up scrap, said machine having a horizontally disposed hammer crusher or breaker rotor as a rotary crushing member that is disposed in a housing, the bottom of which is trough-shaped, with a material inlet that extends to said rotor and that includes an anvil being provided on the downwardly rotating side of said rotor, and with an impact or deflection chamber that has outlet opening means being disposed above said rotor, the improvement therewith wherein:

said housing has a curved inner surface portion in said bottom trough, and a further inner surface means that adjoins said curved inner surface portion and is on the upwardly rotating side of said rotor, said further inner surface means being provided with ribs that are disposed at the outlet opening means for the material outlet and disposed parallel to the direction of movement of broken-up scrap for diving a stream of the latter into several smaller streams, with the open distance between adjacent ones of said ribs being approximately equal to the greatest desired diameter of broken-up and compressed pieces of scrap, and with respective channels being formed between adjacent ones of said ribs for respective ones of said smaller streams of broken-up scrap, with said channels each having an upper end; and deflector rim means is disposed above said ribs and extends parallel to the axis of rotation of said rotor, with said deflector rim means, in conjunction with said further inner surface means of said housing, defining respective unobstructed openings for said upper ends of said channels between said ribs, with these unobstructed openings being adjustable during operation of said breaking-up machine and thus being variable as to material outlet conditions to let out scrap that cannot be reduced in size without need for having said breaking-up machine come to a standstill to let out scrap that cannot be reduced in size, and leading out of said impact or deflection chamber.

2. A sorting apparatus according to claim 1, which includes a flap having a surface that faces the interior of said housing, said last-mentioned surface of said flap forming said further inner surface means, which is provided with said ribs; said flap is adjustable during operation of said breaking-up machine, and has a bottom portion that is pivotable connected to said housing via a pivot shaft that is disposed approximately at the level of, and parallel to, said axis of rotation of said rotor; and in which said deflector rim means is part of said housing and cooperates with said flap to delimit said unobstructed openings of said channels between said ribs.

3. A sorting apparatus according to claim 2, in which the height of said ribs, as measured from said flap, increases from the bottom toward the top, i.,e. in the direction toward said unobstructed openings, with the greatest height of said ribs being at least equal to the greatest desired diameter of broken-up and compressed scrap pieces.

4. A sorting apparatus according to claim 3, in which the length of said ribs is greater than the greatest desired diameter of broken-up and compressed scrap pieces.

5. A sorting apparatus according to claim 1, in which, adjacent to said trough-shaped bottom, said housing includes a wall having a surface that faces the interior of said housing, said last-mentioned surface of said wall forming said further inner surface means, which is provided with said ribs; and which includes flap that is disposed above said wall of said housing and has a bottom edge that forms said deflector rim means and cooperates with said wall to delimit said unobstructed openings of said channels between said ribs: said flap is adjustable during operation of said breaking-up machine, and has a top portion that is pivotably mounted via a pivot shaft that is disposed parallel to said axis of rotation of said rotor.

6. A sorting apparatus according to claim 5, in which the height of said ribs, as measured from said wall, increases from the bottom toward the top, i.,e. in the direction toward said unobstructed openings, with the greatest height of said ribs being at least equal to the greatest desired diameter of broken-up and compressed scrap pieces.

7. A sorting apparatus according to claim 6, in which the length of said ribs is greater than the greatest desired diameter of broken-up and compressed scrap pieces.

* * * * *